United States Patent [19]

O'Brien

[11] Patent Number: 4,968,065

[45] Date of Patent: Nov. 6, 1990

[54] SHIRT POCKET CARD

[75] Inventor: John S. O'Brien, Larkspur, Calif.

[73] Assignee: Thomas M. Freiburger, Belvedere, Calif. ; a part interest

[21] Appl. No.: 185,511

[22] Filed: Apr. 25, 1988

[51] Int. Cl.[5] ..... G09F 1/10; A41B 1/00; A45C 11/18; B42D 15/00

[52] U.S. Cl. ..... 283/117; 40/124.2; 150/53; 206/39

[58] Field of Search ..... 283/1 A, 1 B, 2, 117; 209/613; 150/147, 53; 206/39; 229/92.8; 101/34.1; 346/134; 40/124, 124.2, 124.4

[56] References Cited

U.S. PATENT DOCUMENTS

| | | | |
|---|---|---|---|
| 766,724 | 8/1904 | Noble | 150/147 |
| 776,632 | 12/1904 | Wilson | 150/147 |
| 1,122,110 | 12/1914 | Hansen | 283/45 |
| 1,554,467 | 9/1925 | Stratton | 283/1 A |
| 2,767,756 | 10/1956 | Niles | 206/39 |
| 2,828,975 | 4/1958 | Wright | 150/147 |
| 4,016,664 | 4/1977 | Kaufmann | 150/147 |
| 4,451,067 | 5/1984 | Williams | 40/124.2 |
| 4,674,628 | 6/1987 | Prinsloo et al. | 206/39 |

OTHER PUBLICATIONS

Copy of Standard 3"×5" Index Card.
Pad Sheet with Lines at Both Sides.

*Primary Examiner*—Douglas D. Watts
*Assistant Examiner*—Paul M. Heyrana
*Attorney, Agent, or Firm*—Thomas M. Freiburger

[57] ABSTRACT

A note card is sized and shaped for repeated insertion into a shirt pocket. The preferably white card has lines for notes on a front side, and rounded corners to help the card slide into a pocket repeatedly with little resistance. The card is of a certain selected thickness and stiffness, for a ceratin "feel" and to help it slide into the pocket without buckling. The front side of the card preferably has a "dull coat" surface finish selected to promote ease of writing, particularly with inks pens. The back surface of the card may be blank for obscuring it in shirt pocket, or it may have lines if used with a shirt of opaque material.

15 Claims, 3 Drawing Sheets

SHIRT POCKET CARD

BACKGROUND OF THE INVENTION

The invention is in the field of writing paraphernalia and relates particularly to an attractive and convenient notecard which is sized and constructed to be readily received in a shirt pocket.

Writing equipment, notepads, memo pads and such items have come in a large variety of different forms. Particularly popular in recent years have been 3M's "Post It" notepads in various colors and sizes, and with a stripe of pressure sensitive, easily releasable adhesive on the back of each notepaper. Pads of note paper in different sizes have included a magnet on the back of the pad for hanging the pad on a refrigerator; there have been a number of different types of desk notepads or paper containers and dispensers; and of course standard 3" by 5" and 4" by 6" lined index cards have been used for filing information in appropriately sized file boxes.

Until the present invention, however, there was not available a notepad or notepaper or notecard having the usefulness, attractive appearance and the writing feel of the shirt pocket notecards of the invention as described below.

SUMMARY OF THE INVENTION

The notecard of the present invention includes a combination of features which make it attractive, inviting to write on with a fountain, felt tip, rolling ball or ball point pen, and which enable it to very conveniently be stored in a shirt pocket of standard dimensions, for later reference by the user.

The card is sized to easily fit into a standard shirt pocket, and preferably also to fit six of the cards on a standard letter-size sheet, for photocopying or for filing with six cards adhered to such a sheet.

At least the bottom two corners of the shirt pocket notecard of the invention are rounded to help facilitate the insertion of the card into a shirt pocket. In addition, the card is of sufficient paper weight and stiffness to enable it to be inserted into a shirt pocket in which it fits fairly closely, without buckling. The card is of "cover weight," or "bookweight" (at least 80-lb. and preferably about 100 lb). The rounded corners and the weight of the paper enable the card to be repeatedly inserted into and removed from a short pocket (as for repeated entries onto the card or repeated references) without bending or fraying.

The front surface of the notecard of the invention has a series of parallel horizontal lines (or other patterns which lend themselves to the orderly recording of information) for receiving notes or list items. There may be a vertically extending shaded area along the left margin of the lines for letters, numbers, times, dates, amounts, etc. The cards may come in a number of colors, each for a different purpose, or they may be white. Colors may be coordinated to match common pastel shirt colors, such as light blue, yellow, pink, light beige, etc. Preferably, the back surface of the card is plain, without lines or markings, so that neither the card nor and markings tend to show through the shirt pocket of the user. Alternatively, the back face of the card can deliberately display a company name or logo to promote the company.

The front surface of the card (and preferably the back surface) is coated, preferably having a "dull coat" finish. Such a finish, or an equivalent finish, gives a very good writing feel, particularly with a felt tip or rolling ball type pen, and also with a soft pencil or a ball point pen or other type of ink pen. It also tends to dry the ink almost immediately, preventing smearing, and exhibits almost no "bleeding" away from the lines of the writing as drawn. The finish exhibits colors very well.

A packet of the shirt pocket cards may be contained and dispensed in an attractive desk top dispenser, such as of wood, metal or molded plastic, with the cards oriented vertically or horizontally.

It is therefore among the objects of the invention to provide an attractive and conveniently used notecard which is sized and constructed to fit into a standard shirt pocket, for easy later reference of the user. These and other objects, advantages and features of the invention will be apparent from the following description of a preferred embodiment, considered along with the accompanying drawings.

DESCRIPTION OF THE PREFERRED EMBODIMENTS

Figure 1:
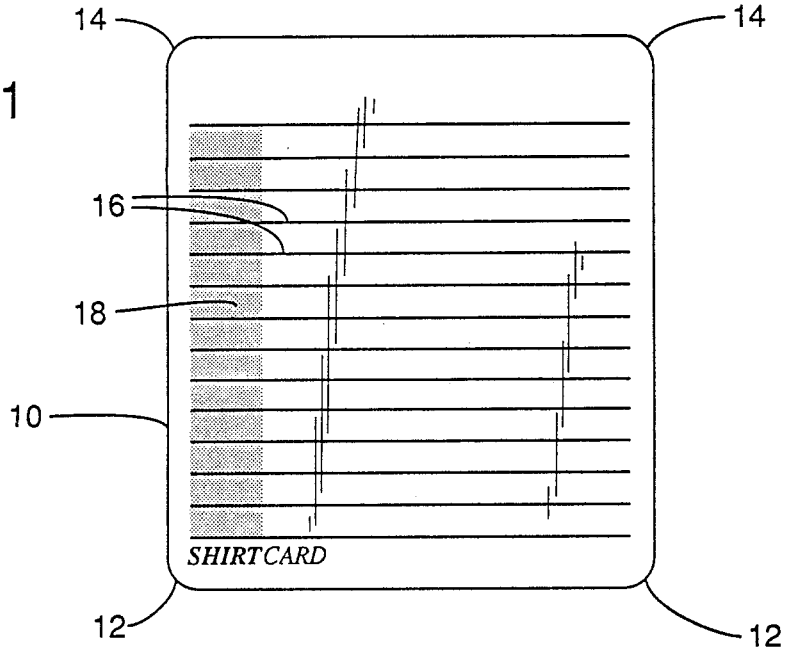
FIG. 1 is a frontal plan view of a shirt pocket notecard in accordance with the invention.

In the drawings, FIG. 1 shows a shirt pocket notecard 10 according to the invention, generally rectangular in shape with two rounded bottom corners 12 and preferably rounded upper corners 14 as well. On the face of the shirt pocket notecard are a series of parallel horizontal lines 16 spaced appropriately for the taking of notes by the user. The front face of the card 10 may also include a shaded area 18 extending vertically down the left margin along the edges of the lines 16 as illustrated The card 10 may be white or off-white in color, but a series of different colors for different cards may be used to signify different types of subject matter or purposes for the user.

Figure 2:
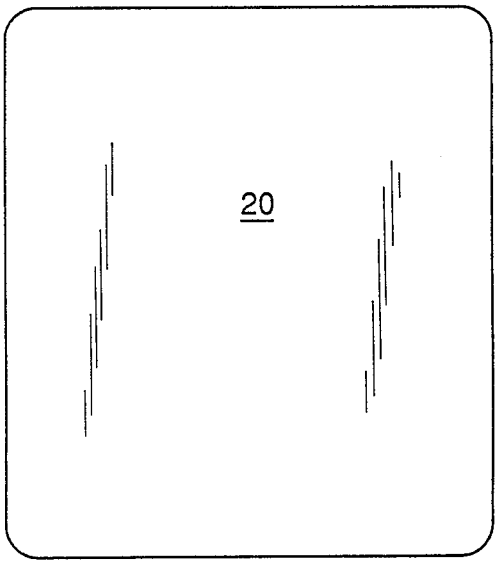
FIG. 2 is a view of the back side of the shirt pocket notecard.
Figure 4:
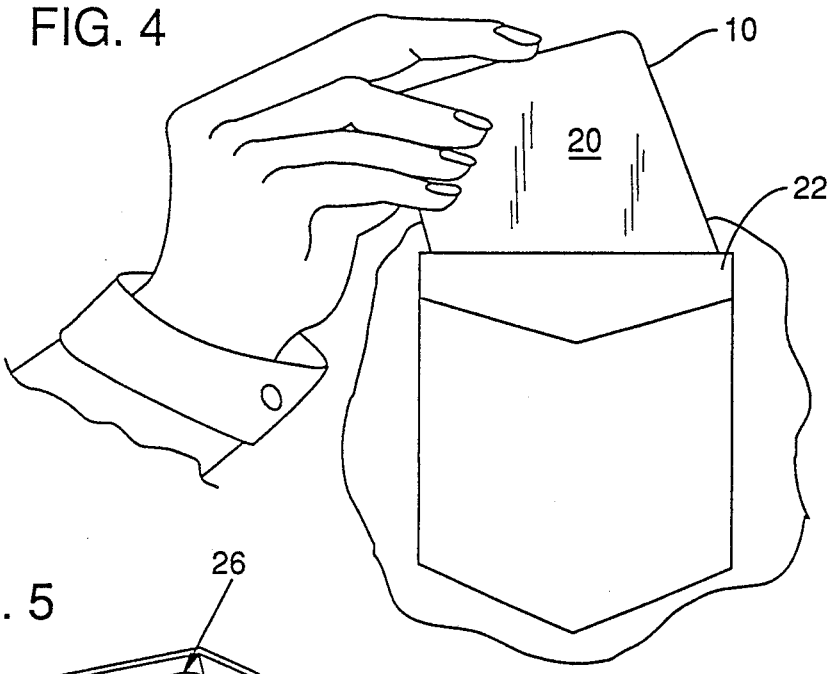
FIG. 4 is a perspective view showing the shirt pocket notecard being inserted into the shirt pocket of a user.

In any event, the back side 20 of the shirt pocket notecard as shown in FIG. 2, preferably is blank, without lines or any other indicia, and most preferably is of a very pale color. As a result, the notecard 10 when inserted into a pocket 22 (as shown in FIG. 4), with the back side 20 facing outwardly, will not show through the pocket 22. Alternatively, if the card is to be used with shirts having opaque pockets, lines may be included also on the back side. Also, in some instances it may be desirable to put a visible company logo on the back surface of the card, to be visible through the pocket.

Figure 3:
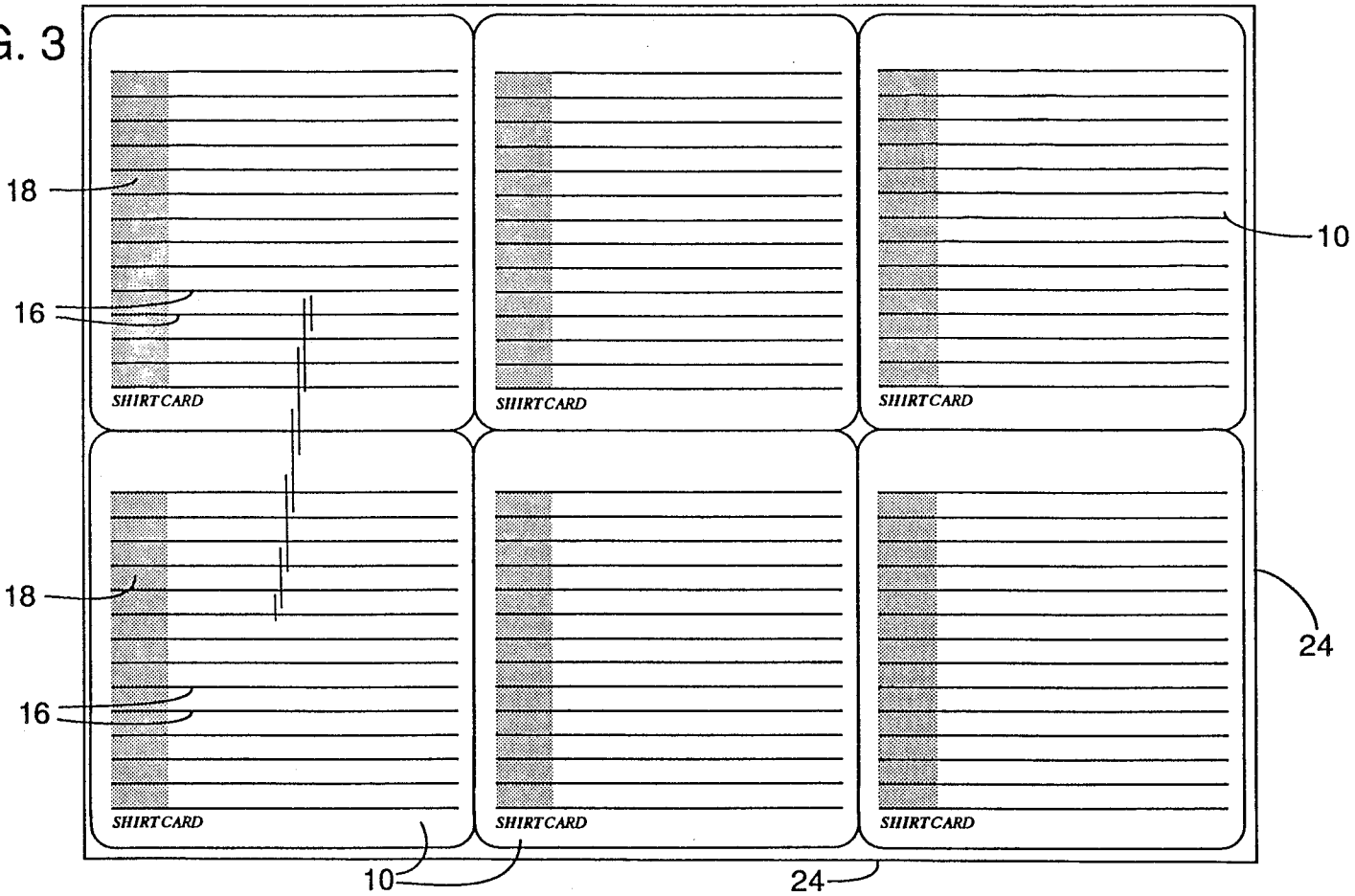
FIG. 3 is a view showing six of the shirt pocket notecards arranged on a sheet of standard letter size paper.

FIG. 3 illustrates an important feature of the shirt pocket notecards 10 of the invention. Each is sized to be approximately the maximum size possible for fitting conveniently into a standard sized shirt pocket, while six of the cards may be laid out as shown in FIG. 3 within the borders of a standard letter size sheet 24. In this way, the six cards can be adhered to and filed on a standard letter sized sheet; or the six cards can be laid face down in this pattern to make a photocopy of their content on a standard letter size sheet.

The dimensions of the cards may therefore be $3\frac{5}{8}$ inches in width by $4\frac{1}{4}$ inches in height for standard letter size paper in the United States; or a maximum of 9.9 centimeters in width by 10.5 centimeters in height, for standard "A4" letter size paper in Europe and other countries, the dimensions of which paper are 21.0 centimeters by 29.7 centimeters.

The surface finish and texture of the shirt pocket notecards 10 of the invention is an important feature, for promoting ease and enjoyment of writing on the surface. The card is preferably coated to achieve the desirable surface finish. The preferred finish is a matte finish with very tight grain, such that virtually no "bleeding" of the ink from a felt tip, fountain or rolling ball type pen will occur. The surface finish is most preferably a "dull coat" as known in the-paper/printing industry. The card stock used preferably is "book weight" or "cover weight," as those terms are known in the industry, and preferably is of about 100-lb. weight. This stock weight should not be less than about 80-lb., and should not exceed about 15-point (0.015 inch in thickness).

Other types of finishes and card stock may be used for the shirt pocket cards of the invention, preferably having an approximately equivalent "feel" to those described above. The card stock used should be such as to approximate a "card" in the general sense of the word, as opposed to a sheet of note paper. The surface finish should be one which dries ink quickly, does not "bleed" the ink to any appreciable degree, and approximates a flat sheen or dull sheen.

In addition as mentioned above, the shirt pocket notecards 10 of the invention can be in a series of colors, preferably very light pastel colors such as yellow, pale blue, pale green, pale pink, pale beige, and ivory, as well as white or off-white, and these cards collectively can be used to signify the subject matter, different days of the week, different purposes, etc. for the user of the card. They can also be matched to popular pastel shirt colors, to allow the card to be less noticeable in the pocket.

Figure 5:
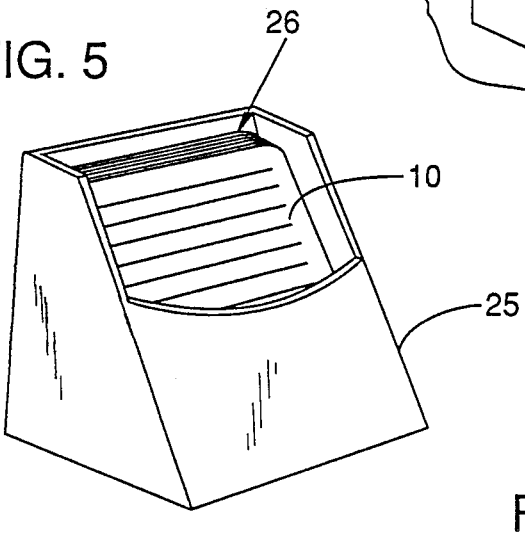
FIG. 5 is a view showing a holder/dispenser containing a packet of the pocket cards of the invention.
Figure 6:
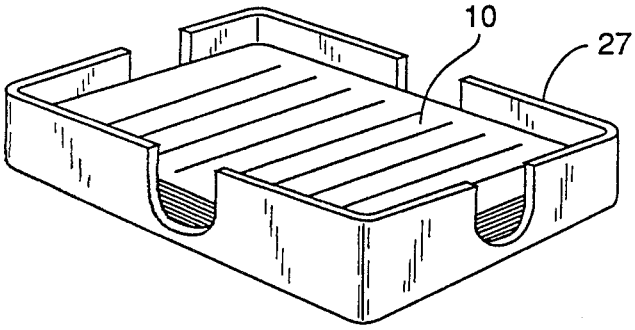
FIG. 6 is a view showing another card holder for retaining the cards in a horizontal stack.

As shown in FIG. 5, the shirt pocket notecards 10 of the invention may be stored and displayed in a convenient container/dispenser 25 which is attractive on a desktop. The container or dispenser 25 may be of finished wood or metal, or even of an attractive plastic or metal coated plastic. It may retain a stack 26 of shirt pocket notecards in any desired orientation. The card stack may be vertical or slightly inclined from vertical as shown in FIG. 5, or horizontal in a tray 27 as shown in FIG. 6. The trademark notation "Shirtcard" may be present on each card and on the container or dispenser 25.

Stacks of the shirt pocket notecards 10 may be "padded," i.e. coated at the top edge of the stack with a rubbery padding substance, so that one may tear cards off the stack one-by-one.

If desired, the backs of the cards 10 can have a small patch of pressure-sensitive adhesive, covered by a removable release strip. This is useful for placing the cards on a vertical surface for prominence as a reminder. However, the preferred form of the card 10 is without any such adhesive.

The above described preferred embodiment is intended to illustrate the principles of the invention, but not to limit its scope. Various other embodiments and modifications to this preferred embodiment will be apparent to those skilled in the art and may be made without departing from the scope of the invention as defined in the following claims.

I claim:

1. A note card for use in writing notes and for insertion in a shirt pocket, comprising, a generally rectangular card having straight edges and having dimensions to enable it to fit into and substantially fill a shirt pocket of conventional size, without extending above the pocket or being exposed, with the height of the card as contained in the pocket greater than its width, and of sufficient stiffness that is easily slides into a shirt pocket repeatedly without buckling, the card being about $4\frac{1}{4}$ inches in height and about $3\frac{5}{8}$ inches in width, rounded corners at least at the bottom of the card, to help enable the card to be inserted in a pocket repeatedly without buckling and without fraying the corners, a series of parallel lines on a front face of the card in a pattern which lends itself to the orderly recording of information, and a back surface of the card which is substantially blank.

2. The note card of claim 1, wherein the card is white at least on the back side.

3. The note card of claim 1, wherein at least the front of the card has substantially a "dull coat" surface finish.

4. The note card of claim 1, wherein the front surface has a margin area at the top, above the lines.

5. The note card of claim 1, wherein the front surface has a shaded area extending vertically down along a left end of the lines, providing an area for entering list numbers, letters, times or other items.

6. The shirt pocket notecard of claim 1, further including a container/dispenser for a stack of the cards, with a card-holding cavity configured to receive and hold the stack of cards in vertical orientation, with a portion of the height of the cards extending above the cavity for convenient retrieval of a card by a user.

7. The shirt pocket notecard of claim 1, further including an open-topped container/dispenser holding a stack of the cards, with a card holding cavity configured to receive and hold and expose the front surface of the stack of cards in horizontal orientation.

8. The shirt pocket card of claim 1, wherein the card is substantially of "cover weight" stock.

9. The shirt pocket card of claim 8, wherein the card is of about 100-lb. stock.

10. The shirt pocket card of claim 8, wherein the card is of stock in the range of about 80-lb. to 15 point, with a surface finish generally equivalent to a "dull coat" finish.

11. The shirt pocket card of claim 8, wherein the card has surface finish means for drying ink quickly, for substantially not "bleeding" ink on the surface, and for providing an approximately flat sheen.

12. The shirt pocket card of claim 1, wherein the card has surface finish means for drying ink quickly, for substantially not "bleeding" ink on the surface, and for providing an approximately flat sheen.

13. The shirt pocket card of claim 1, in combination with a shirt having a breast pocket for receiving the card, and the card having a pastel color substantially matched to the color of the shirt so that the card color does not show through the pocket.

14. A note card for use in writing notes and for insertion in a shirt pocket, comprising, a generally rectangular card having straight edges and having dimensions to enable it to fit into and substantially fill a shirt pocket of conventional size, without extending above the pocket or being exposed, with the height of the card as contained in the pocket greater than its width, and of sufficient stiffness that it easily slides into a shirt pocket repeatedly without buckling, the card being about 10.5 centimeters in height and about 9.9 centimeters in width, rounded corners at least at the bottom of the card, to help enable the card to be inserted in a pocket repeatedly without buckling and without fraying the corners, a series of parallel lines on a front face of the card in a pattern which lends itself to the orderly recording of information, and a back surface of the card which is substantially blank.

15. A note card for use in writing notes and for insertion in a shirt pocket, comprising, a generally rectangular card having straight edges and having dimensions to enable it to fit into and substantially fill a shirt pocket of conventional size, without extending above the pocket or being exposed, with the height of the card as contained in the pocket greater than its width, and of sufficient stiffness that is easily slides into a shirt pocket repeatedly without buckling, rounded corners at least at the bottom of the card, to help enable the card to be inserted in a pocket repeatedly without buckling and without fraying the corners, a series of parallel lines on a front face of the card in a pattern which lends itself to the orderly recording of information, at least the front surface of the card having substantially "dull coat" surface finish, and a back surface of the card which is substantially blank.

* * * * *